United States Patent [19]

Aitken

[11] Patent Number: 4,972,684

[45] Date of Patent: Nov. 27, 1990

[54] BANGLE HAVING REMOVABLE ATOMIZER AND INTERCHANGEABLE DECORATIVE CLIPS

[75] Inventor: Alexander G. Aitken, Inglewood, Australia

[73] Assignee: Atmos Energy, Dallas, Tex.

[21] Appl. No.: 335,447

[22] Filed: Apr. 10, 1989

[51] Int. Cl.[5] ..... A44C 5/00

[52] U.S. Cl. ..... 63/8; 63/7; 63/DIG. 2

[58] Field of Search ..... 63/8, DIG. 2, 1.1, 2, 63/6, 7, 11, DIG. 3; 239/36, 55, 56, 653, 152–154, 211; 428/905; 222/78, 175, 325

[56] References Cited

U.S. PATENT DOCUMENTS

| | | | |
|---|---|---|---|
| 1,780,407 | 11/1930 | Smith . | |
| 2,180,980 | 11/1939 | Fassnacht et al. | 63/7 |
| 2,235,350 | 3/1941 | Anderson . | |
| 2,522,852 | 9/1950 | Apps | 63/7 |
| 3,270,525 | 9/1966 | Sellers . | |
| 3,952,917 | 4/1976 | Gause . | |
| 4,058,237 | 11/1977 | Luke . | |
| 4,159,631 | 7/1979 | Lee . | |
| 4,241,850 | 12/1980 | Speer . | |
| 4,674,299 | 6/1987 | Azar | 63/7 |
| 4,753,086 | 6/1988 | Schmidt | 63/DIG. 3 X |

FOREIGN PATENT DOCUMENTS

| | | | |
|---|---|---|---|
| 573347 | 3/1924 | France | 63/DIG. 2 |
| 650144 | 1/1929 | France | 63/DIG. 2 |
| 788465 | 10/1935 | France | 63/DIG. 2 |
| 16564 | of 1887 | United Kingdom | 63/DIG. 2 |
| 204657 | 8/1923 | United Kingdom | 63/DIG. 2 |
| 466988 | 6/1937 | United Kingdom | 63/7 |

*Primary Examiner*—Laurie K. Cranmer

*Attorney, Agent, or Firm*—Ross, Howison, Clapp & Korn

[57] ABSTRACT

A bangle of a generally annular form and of a substantially rigid material, having a cavity in the form of an elongate recess open inwardly of the bangle and having opposite edges at the junction with the internal face of the bangle. A fragrance of scent container received in said cavity and releasably engaged by said edges of the cavity which are adapted to resiliently deflect or deform to permit entry and removal of the container from the cavity. An aperture in the bangle communicating the cavity with the exterior of the bangle, and a manually operable pump mounted on the container and arranged when operated to deliver scent or fragrance from the container through the aperture.

29 Claims, 3 Drawing Sheets

BANGLE HAVING REMOVABLE ATOMIZER AND INTERCHANGEABLE DECORATIVE CLIPS

This invention relates to a bangle as worn on the arm, usually of women and girls, and the object of the invention is to provide such a bangle which has incorporated therein provision for the dispensing of a liquid such as a scent or fragrance.

With this object in view, there is provided according to the present invention, a bangle of a generally annular form and of a substantially rigid material, a cavity in a section of the bangle and open inwardly thereof, a fragrance of scent container received in said cavity and releasably engaged with the bangle, an aperture in the bangle communicating the cavity with the exterior of the bangle, and a manually operable pump mounted on the container and arranged when operated to deliver scent or fragrance from the container through the aperture.

Preferably the pump is located so that it may be digitally operated from inside of the bangle to issue a spray through the aperture from the opposite side of the bangle.

Conveniently the cavity is in the form of an elongate recess open inwardly of the bangle and having opposite edges at the junction with the internal face of the bangle, said edges being adapted to resiliently deflect or deform to permit entry and removal of the container from the cavity.

The bangle may take a wide variety of forms, including a one-piece or multi-piece bangle. The multi-piece bangle may take the form of two or more annular elements assembled together in a coaxial relationship to form the complete bangle. In a further form, the bangle may be in the form of two semi-curcular sections or a number of arcuate sections hinged or otherwise connected, with the cavity located in one section. Conveniently there are two substantially semi-circular sections releasably interconnected to each other and each end. Alternatively the two sections are pivotally connected at one end and are releasably interconnected at the other end.

There may be provided to combine with the bangle at least one annular member having an internal face complementary to an annular portion of the external face of the bangle, said internal and external faces having respective snap action engageable element to secure the annular member to the bangle. Alternatively there may be provided two semi-circular members each having an internal face complementary to the external face of the respective sections of the bangle, said internal and external faces having respective snap action engageable elements to secure the semi-circular members to the respective bangle sections.

The invention will be more readily understood from the following description of several embodiments of a bangle incorporating the present invention and as depicted in the accompanying drawings. In the drawings.

Figure 1:
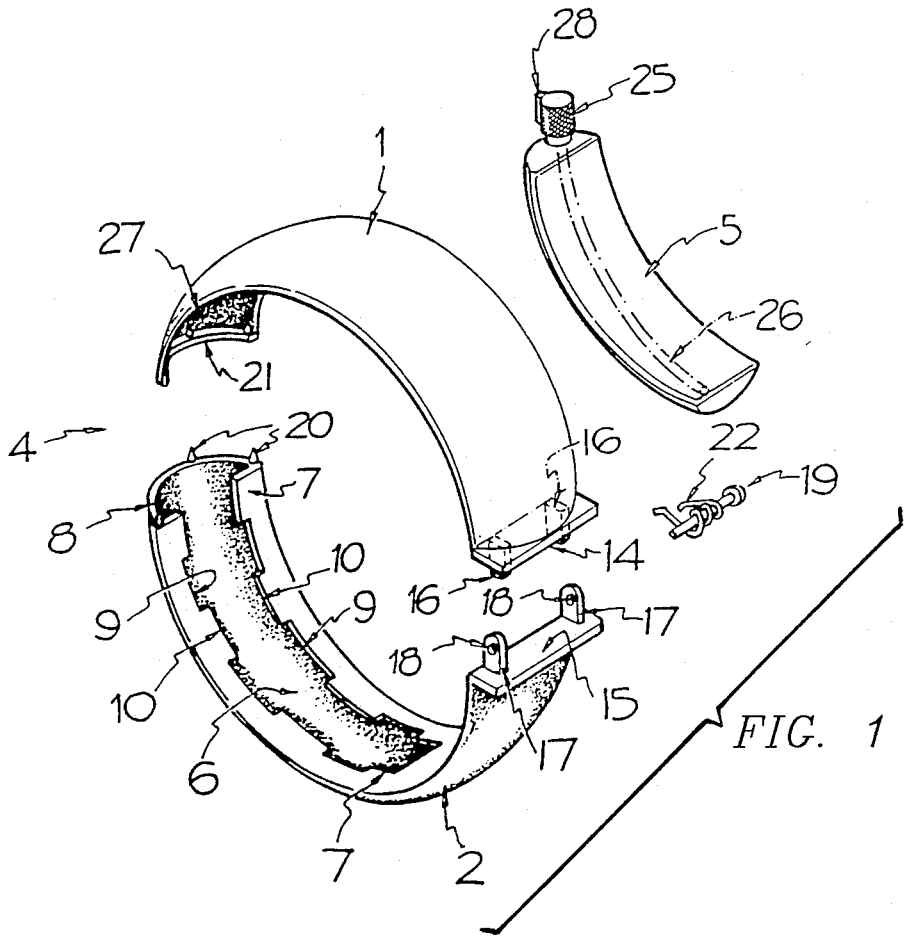
FIG. 1 is an exploded perspective view of one embodiment of the invention.
Figure 4:
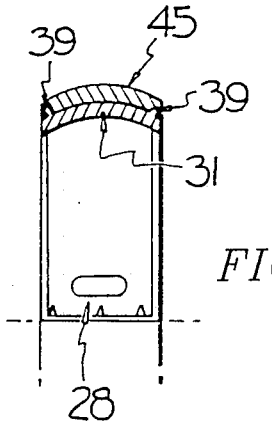
FIG. 4 is a partial sectional view along the line A—A in FIG. 3.

Referring now to FIG. 1 of the drawings, the bangle comprises two arcuate sections 1 and 2, which together constitute a complete substantially true circle annular bangle. The sections 1 and 2, which for convenience will be referred to respectively as the top and bottom sections, are hingeably connected by a hinge structure at 3 and may be secured in the true circle annular form by inter-engaging elements on the respective sections 1 and 2 at 4.

The lower section 2 has an inwardly open recess 6 extending from the end face 8 through an arc of approximately 90° . The arcuate length of the recess 6 may vary from 90° in either direction in accordance with the capacity of the fragrance reservoir as hereiafter referred to. The oppositely facing edges 7 of the recess 6 are provided with spaced notches 9 so as to provide along said edge a plurality of spaced tangs 10.

The end portions 11 and 12 of the upper and lower sections 1 and 2 of the bangle present opposed generally flat faces 14 and 15, with pairs of lugs 16 and 17 respectively projecting therefrom. When assembled the lugs 16 are received between the lugs 17 with the apertures 18 in the respective lugs aligned. The pivot pin 19 passes through the apertures 18 to secure the upper and lower sections 1 and 2 in a hinged relation. A torsion spring 22 in FIG. 1, may be supported on the pin 18 between the lugs 16 with the spring 22 configured to either apply forces to the end portions 11 and 12 of the upper and lower sections 1 and 2 so as to either urge them in a direction to open or close the sections relative to one another.

The end face 8 of the lower section 2 is provided with a series of three projections 20 and the complementary face 21 on the upper section 1 is provided with complementary recesses (not shown) to receive in frictional engagement the projections 20. The projections 20 and the complementary recesses are dimensioned so that when inter-engaged, sufficient frictional forces will be developed therebetween to maintain the upper and lower sections of the bangle in a closed full circle configuration, whilst in position on the arm of the wearer, and to withstand such forces as will normally be encountered while being worn.

The fragrance container 5 is of an arcuate shape and of a generally semi-circular cross-section so as to be complementary to the recess 6 in the lower section 2 of the bangle. The container 5 is of a hollow construction so that a quantity of a fragrance or scent may be held therein. A conventional pump unit as commonly used dispensing fragrances or scents from bottles or the like, is fitted to one end of the container 5, as indicated at 25, with the conventional tube 26 extending from the pump 25 to adjacent the opposite end of container 5, and with the end thereof open in free communication with the interior of the container 5.

The container 5 and the recess 6 are dimensioned so that the container 5 may nest within the recess 6 and the tangs 10, and to a lesser extent the edge portions 7, are sufficiently resiliently deformable so that the container 5 may be snapped into position in the recess 6 by applying generally radially directed forces between the lower section 2 of the bangle and the container 5 to effect assembly thereof. It will be appreciated that the arcuate cross-section of the lower section 2 of the bangle, in the area where the recess 6 is provided, will enable a degree of expansion of the lower section of the bangle to increase the dimension between the oppositely opposed tangs 10 to assist in the snap action assembly of the container 5 in addition to the deflection of the tangs 10.

An aperture 27 is provided in the arcuate surface of the upper section 1 of the bangle adjacent the end 8 of the lower section 2. The aperture 27 is positioned so that when the upper and lower sections of the bangle are in the closed position, the nozzle 28 of the pump unit 25 will be aligned with the aperture 27. With this arrangement, the fragrance or scent dispensed from the container 5 through the nozzle 28 will pass through the aperture 27 to be applied as desired by the wearer of the bangle.

Figure 2:
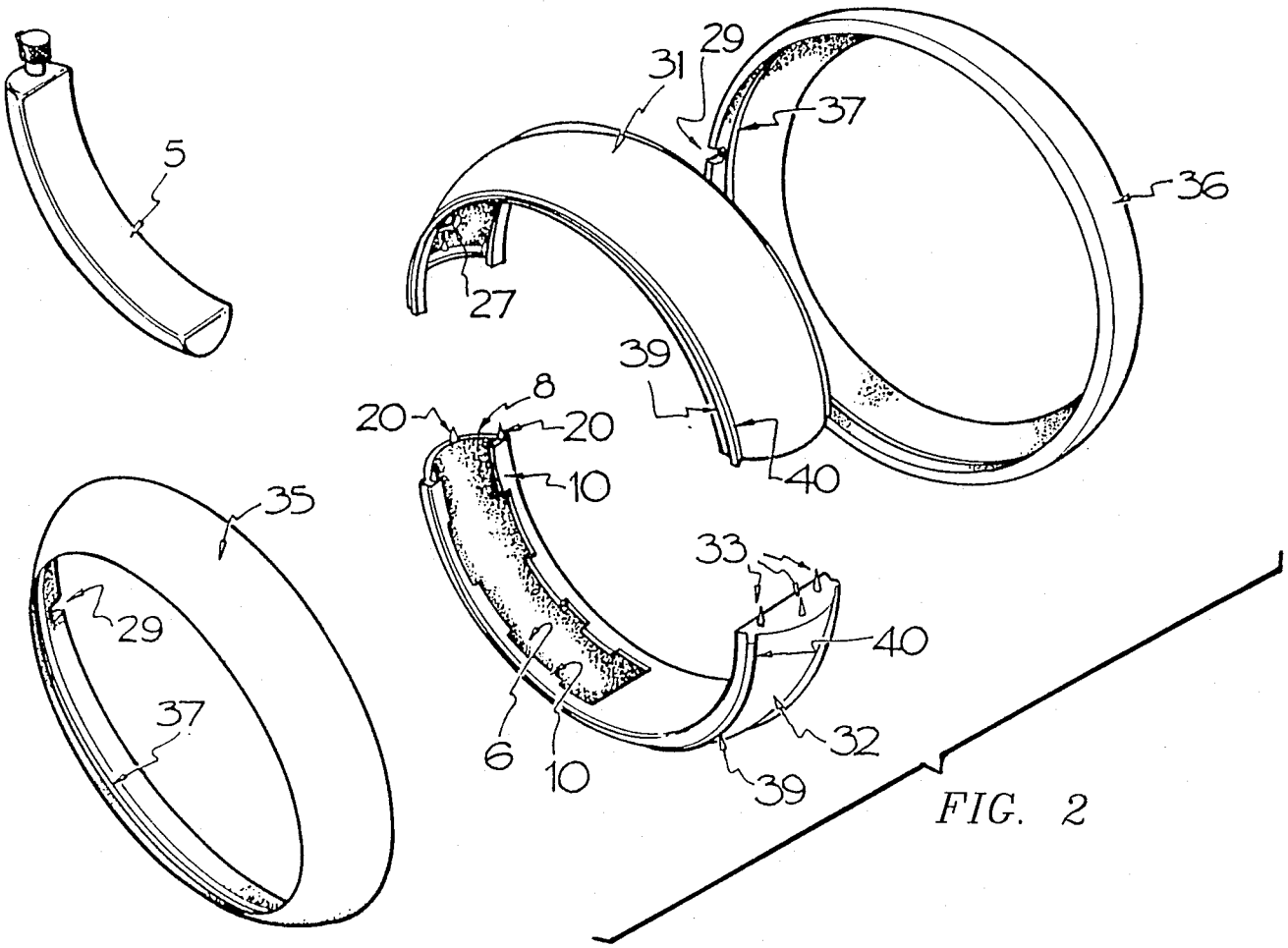
FIG. 2 is an exploded view of the second embodiment of the invention.

In the alternative construction of the bangle as shown in FIG. 2, the general constructions of the upper and lower sections 31 and 32 are the same as previously described with respect to FIG. 1, except the hinge assembly 3 has been replaced by a series of projections 33 and complementary holes 34 in each of the ends of the upper and lower sections 31 and 32. The two sections 31 and 32 are thus secured together by the engagement of the pins in the respective ends of the lower section 31 with the cavities in the upper section 32 and the development of the frictional forces therebetween. The recess 6 in the lower section 32 of the embodiment in FIG. 2 is of the same construction as previously described with respect to FIG. 1 and shall not be further described herein. Also the fragrance container 5 is of the same constructions as previously described and is assembled into the recess 6 in the same manner.

The principal difference between the construction shown in FIG. 1 and 2 is the provision of snap-on outer rings 35 and 36, which may be releasably attached to the bangle formed by the assembly of section 31 and 32 together. Each of the snap-on rings is of the same construction, each being of a slightly dished form with an internal annular shoulder 37. The outer generally semi-circular external surface of the annulas, formed by the assembly of sections 31 and 32, is provided with outwardly projecting ribs 39 which form shoulders 40. It will be appreciated that when the upper and lower sections 31 and 32 are assembled together, the snap-on rings 35 and 36 can be assembled thereto from the respective sides of the bangle, with the shoulders 37 on the snap-on rings snapping and locking onto the shoulders 40 on the bangle sections 31 and 32.

The provision of the snap-on rings 35 and 36 are for the purpose extending the use of the bangle so that snap-on rings of different colours may be applied to the basic assembly of the upper and lower sections 31 and 32 of the bangle to provide required colour co-ordination with the clothing being worn. Apart from the snap-on rings being different in colour from the basic bangle, they may also differ in colour from one another. In a further modification, the snap-on rings may have an axial length selected so that when the two snap-on rings are assembled to the base bangle, there remains an annular strip on the base bangle exposed between the opposing edges of the snap-on rings, which gives a further colour combination.

Figure 3:
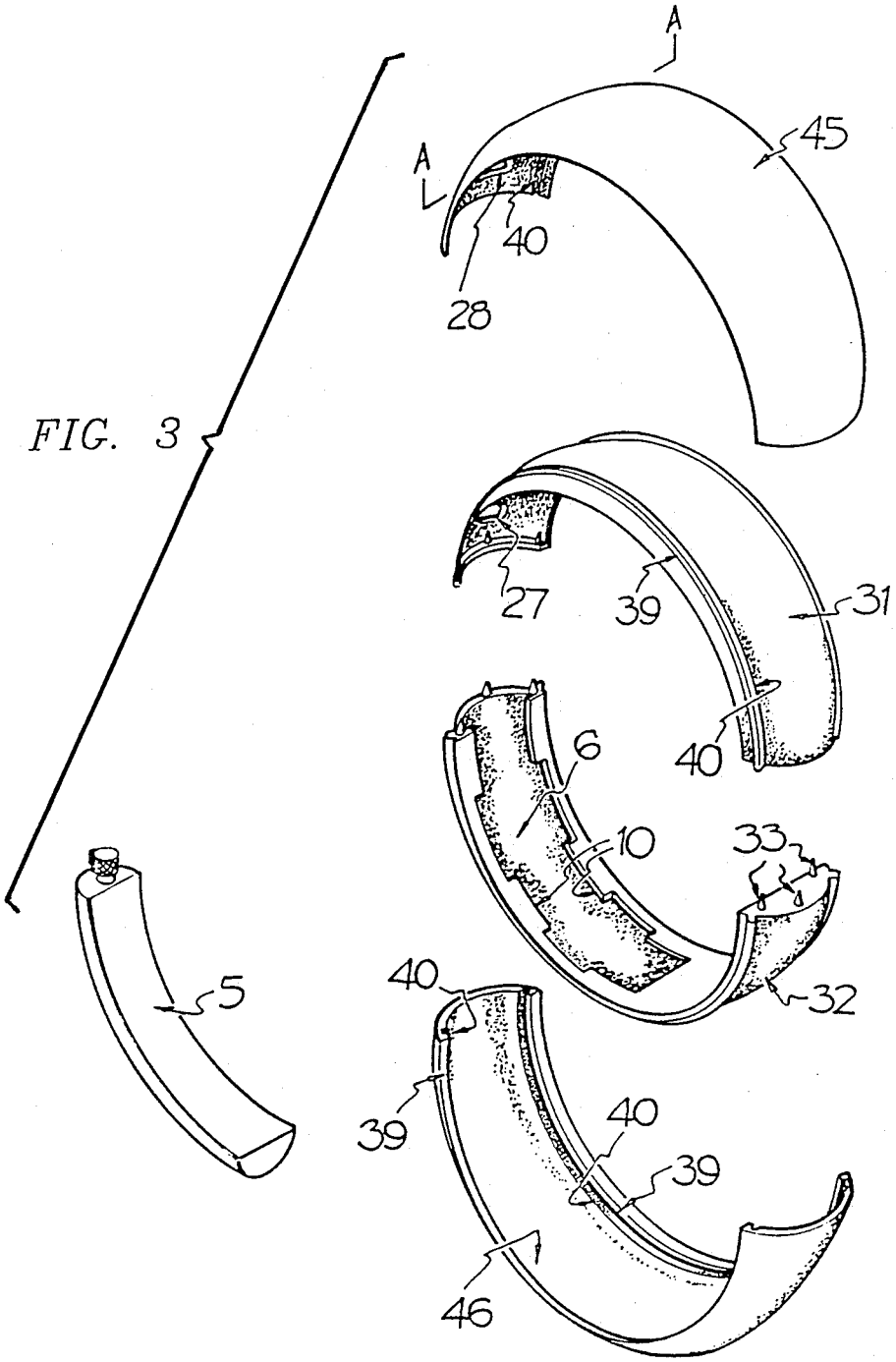
FIG. 3 is an exploded view of a third embodiment of the invention.

FIG. 3 is a further modification of the bangle where an alternative construction of a snap-on section is provided. The upper and lower sections 31 and 32 of the base bangle are identical to that previously described with reference to FIG. 2 of the drawings, including the provision of the peripheral ribs 39 and shoulders 40. In this modification the snap-on sections 45 and 46 are of semi-circular configuration, and in cross-section generally correspond to the cross-section of the external face of the bangle sections 31 and 32. Each of the snap-on sections 45 and 46 are again provided on the internal surface with shoulders 47 and 48, which inter-engage in a snap action with the shoulders 40 on the bangle sections 31 and 32. Again, the snap-on sections 45 and 46 are provided purely for decorative purposes and are of a different colour to the main sections 31 and 32 of the bangle and if desired two snap-on sections of different colour may be assembled to the one bangle.

In each of the constructions described with reference to the accompanying drawings, the bangles may be made of any suitable mouldable material and preferably the two sections of the bangle are made of polypropylene whilst the snap-in fragrance or scent container may be made of a low density polyethylene. Normally the snap-on outer rings or sections that may be applied to the base bangle will also be made of polypropylene.

I claim:

1. A bangle for being worn on the body, comprising:

an annular member having a wall comprising a interior surface and an exterior surface, the interior surface conforming to a portion of the body against which the bangle is to be worn;

a recess formed in the interior surface of said annular member;

a sealed receptacle for storing a liquid having predetermined characteristics, said receptacle having a mechanical pump integrally associated therewith for atomizing the liquid into a mist through an atomizing orifice, said receptacle dimensioned to fit within said recess;

an orifice disposed in the wall of said annular member and interfacing between said recess and the exterior surface of said annular member; and securing means for removably securing said receptacle in said recess with said pump disposed proximate to said orifice to allow access to said pump through said orifice, said atomizing orifice directed outward from said recess through said orifice.

2. A bangle as claimed in claim 1, wherein said recess is in the form of an elongate recess open inwardly of said annular member and having opposite and bounding edges parallel to each other and proximate to the interior surface of said annular member, said edges being adapted to resiliently deflect or deform to permit entry and removal of said receptacle from said recess.

3. A bangle as claimed in claim 2 having a plurality of spaced tangs along at least one of said opposite edges to resiliently deflect or deform.

4. A bangle as claimed in claim 3, wherein said annular member comprises two or more sections interconnected in an annular formation.

5. A bangle as claimed in claim 3 wherein said annular member comprises two substantially semi-circular sections releasably inter-connected to each other at each end.

6. A bangle as claimed in claim 3, wherein said annular member comprises two substantially semi-circular sections pivotally connected at one end and are releasably inter-connected at the other end.

7. A bangle as claimed in claim 6 including means interacting between said two sections to urge said other ends of said sections together.

8. A bangle as claimed in claim 2, wherein said annular member comprises two or more sections interconnected in an annular formation.

9. A bangle as claimed in claim 2, wherein said annular member comprises two substantially semi-circular sections releasably inter-connected to each other at each end.

10. A bangle as claimed in claim 9, wherein said recess is disposed in one of said sections and the pump on said receptacle extends into a second recess in an adjoining portion of the other of said sections, said orifice being formed in said second recess in the other of said sections.

11. A bangle as claimed in claim 2, wherein said annular member comprises two substantially semi-circular sections pivotally connected at one end and are releasably inter-connected at the other end.

12. A bangle as claimed in claim 11 including means interacting between said two sections to urge said other ends of said sections together.

13. A bangle as claimed in claim 12, wherein said recess is disposed in one of said sections and said pump on said receptacle extends into a second recess in an adjoining portion of the other of said sections, said orifice being formed in said second recess in the other of said sections.

14. A bangle as claimed in claim 11, wherein said recess is disposed in one of said sections and said pump on said receptacle extends into a second recess in an adjoining portion of the other of said sections, said orifice being formed in said second recess in the other of said sections.

15. A bangle as claimed in claim 1 wherein said annular member comprises two or more sections interconnected in an annular formation.

16. A bangle as claimed as claim 15 and an annular plate having an internal face complementary to the external surface of said annular member, said internal face of said plate and said external surface of said annular member having respective snap action engageable elements to secure said plate to the surface of said annular member.

17. A bangle as claimed in claim 16 and comprising two said annular plates secured to said annular member with said plates in opposing relation on opposite sides of said annular member.

18. A bangle as claimed in claim 1 wherein said annular member comprises two substantially semi-circular sections releasably inter-connected to each other at each end.

19. A bangle as claimed in claim 18, wherein said recess is formed in one of said sections and said pump on said receptacle extends into a second recess in an adjoining portion of the other of said sections, said orifice being formed in said recess in said one section.

20. A bangle as claimed in claim 19 and an annular plate having an internal face complementary to the external surface of said annular member, said internal face of said plate and said external surface of said annular member having respective snap action engageable elements to secure said plate to the surface of said annular member.

21. A bangle as claimed in claim 18 and two semi-circular plates each having an internal face complementary to the external surface of the respective sections of said annular member, said internal face of said plates and the external surfaces of said sections having respective snap action engageable elements to secure said semi-circular plates to the respective sections.

22. A bangle as claimed in claim 18 and an annular plate having an internal face complementary to the external surface of said annular member, said internal face of said plate and said external surface of said annular member having respective snap action engageable elements to secure said plate to the surface of said annular member.

23. A bangle as claimed in claim 1 wherein said annular member comprises two substantially semi-circular sections pivotally connected at one end and are releasably inter-connected at the other end.

24. A bangle as claimed in claim 23 including means interacting between the two sections to urge said other ends of the sections together.

25. A bangle as claimed in claim 24 and an annular plate having an internal face complementary to the external surface of said annular member, said internal face of said plate and said external surface of said annular member having respective snap action engageable elements to secure said plate to the surface of said annular member.

26. A bangle as claimed in claim 23 and an annular plate having an internal face complementary to the external surface of said annular member, said internal face of said plate and said external surface of said annular member having respective snap action engageable elements to secure said plate to the surface of said annular member.

27. A bangle as claimed in claim 23, and comprising two of said semi-circular plates each having an internal face complementary to the external surface of the respective sections of said annular member, said internal face and said external surface having respective snap action engageable elements to secure said semi-circular plates to the respective ones of said sections.

28. A bangle as claimed in claim 1 and an annular surface plate having an internal surface complementary to the external surface of said annular member, said internal surface of said annular surface plate and said external surface of said annular member having respective snap action engageable elements to secure said annular surface plate to said annular member.

29. A bangle as claimed in claim 28 and comprising two of said annular surface plates secured to said annular member with said annular surface plates in opposing relation on opposite sides of said annular member.

* * * * *

UNITED STATES PATENT AND TRADEMARK OFFICE

CERTIFICATE OF CORRECTION

PATENT NO. : 4,972,684

DATED : November 27, 1990

INVENTOR(S) : Alexander G. Aitken

It is certified that error appears in the above-identified patent and that said Letters Patent is hereby corrected as shown below:

ON TITLE PAGE:

[73] Assignee: Delete "Atmos Energy, Dallas, Tex." and insert therefore -- Body Care Products Pty. Limited, South Perth, W. Australia --.

Signed and Sealed this

Fifth Day of May, 1992

*Attest:*

DOUGLAS B. COMER

*Attesting Officer*

*Acting Commissioner of Patents and Trademarks*